US005993333A

United States Patent [19]

Heckaman

[11] Patent Number: 5,993,333

[45] Date of Patent: Nov. 30, 1999

[54] SWING TRAINING METHOD WITH GAME BALL HITTING IMPLEMENT

[76] Inventor: Thomas W. Heckaman, 451 E. Main, P.O. Box 781, Beach, N. Dak. 58621

[21] Appl. No.: 09/157,438

[22] Filed: Sep. 21, 1998

[51] Int. Cl.[6] ..... A63B 69/36

[52] U.S. Cl. ..... 473/409; 473/220; 473/453; 473/457

[58] Field of Search ..... 473/220, 286, 473/409

[56] References Cited

U.S. PATENT DOCUMENTS

| | | | |
|---|---|---|---|
| 5,299,846 | 4/1994 | Rush | 473/286 X |
| 5,665,006 | 9/1997 | Pellegrini | 473/220 |
| 5,725,440 | 3/1998 | Finney | 473/220 |

*Primary Examiner*—George J. Marlo
*Attorney, Agent, or Firm*—David A. Lingbeck

[57] ABSTRACT

A swing trainer device includes a laser beam mechanism having a laser beam light source and batteries for emitting a laser beam, and further includes a laser beam attachment member which is essentially a flexible sleeve having an open first end which is removably engaged about the end of either the handle of a golf club or the barrel of a bat, and further having an open second end which is securely engaged about the end of the back portion of the laser beam mechanism. A laser beam is directed away from and in the same plane as the handle of the golf club or the barrel of the bat. This swing trainer device is swung in a single plane to help the user maintain a consistent swing each and every time through muscle memorization.

12 Claims, 3 Drawing Sheets

SWING TRAINING METHOD WITH GAME BALL HITTING IMPLEMENT

BACKGROUND OF THE INVENTION

This invention relates to a swing trainer device and the method of using the same which is attachable to the end of the handle of any golf club and to the end of the barrel of any bat and which allows the player to instantly see the path of his/her swing and to correct or alter the path of his/her swing immediately.

The games of golf and baseball are played by striking the ball with a golf club and a bat. For either game, the player must have developed a particular swing which allows the player to effectively strike the ball on a consistent basis. In golf for the player to be competitive, the player must have perfected his/her swing in order to hit the ball the same way each and every time so that the player will know how to address the ball for each and every shot so that the player will hit the ball not only for distance but also for accuracy. If the player does not have the same swing each and every time, he/she will not be able to hit the ball accurately and for distance each and every time.

In baseball for the player to be competitive, the player must be able to hit a pitched baseball, and since the pitched baseball more often than not travels in a straight path, the player who has developed a level swing rather than an upper swing or a looping swing has a much better chance of making contact with the pitched baseball. For either game, it is difficult for the player to visualize whether or not he/she has a good swing without either someone in person watching his/her swing or the player being filmed while swinging and then watching the film later.

One known prior art is a GOLF SWING TRAINING DEVICE, U.S. Pat. No. 5,544,888, issued on Aug. 13, 1996 and invented by John T. Pellegrini and which comprises a light source generating a parallel light beam and also comprises a threaded fastener attached to the light source and which is threaded into the end of the handle of the golf club.

Another known prior art is a GOLF SWING TRAINING DEVICE, U.S. Pat. No. 3,820,795, issued on Jun. 28, 1974 and invented by David L. Taylor and which comprises a snap fitting attachment for the hosel of the golf club, a light source carried by the snap fitting attachment and directing a light beam upwardly, and a hosel entrance opening on the attachment.

Another known prior art is a LASER BEAM GOLF SWING TRAINING DEVICE, U.S. Pat. No. 3,953,034, issued on Apr. 27, 1976 and invented by Rodney L. Nelson and which comprises a laser beam source mounted on the shaft of the golf club and a convex mirror located on the golf club head between the club face and hosel to spread the laser beam into a fan of light and project the same forwardly and downwardly at a 90 degree angle to the golf club face.

None of the prior art discloses a swing trainer device and the method of using the same as disclosed in the present invention.

SUMMARY OF THE INVENTION

The present invention relates to a swing trainer device and the method of using the same comprising a conventional short pen-like laser beam mechanism which includes a narrow housing, a laser beam diode disposed inside the housing, a switch, a spring, and an energy source such as a battery also removably disposed inside the housing, and also comprises a flexible sleeve having a first end which is adapted to engageably receive a portion of the pen-like laser beam mechanism and further having a second end which is adapted to engageably receive the end of the handle of any golf club or the end of the barrel of a bat. In golf, as the player swings the club back, the laser beam moves in a path 180 degrees to the path of the club head and also moves in the same plane as the club head. As the player starts his/her swing forward, the laser beam will move along the ground and should travel directly over the ball, because where the laser beam was is where the club head will be. If not, the player has to readjust his/her swing so that the club head moves in a plane in order for the player to get the most out of his/her swing either as to accuracy or as to distance. In baseball, the path of the laser beam is in direct correlation with the path of the bat. To be able to see the path of his/her swing, the player should practice his/her swing facing and being spaced from a wall structure so that as the player swings the bat, the laser beam should move in a horizontally disposed hitting zone displayed upon the wall structure.

One objective of the present invention is to provide a swing trainer device which allows the player to immediately see how he/she is swinging either the golf club or a bat.

Another objective of the present invention is to provide a swing trainer device which allows the player to make immediate adjustments or corrections to his/her swing and the player has the opportunity to immediately see and feel those adjustments.

Also, another objective of the present invention is to provide a swing trainer device which can be taken any where and can be quickly and conveniently attached to the golf club or to the bat.

Yet, another objective of the present invention is to provide a swing trainer device which is inexpensive and also allows the player to see and appreciate the improvements made with his/her swing.

Further objectives and advantages of the present invention will become apparent as the description proceeds and when taken in conjunction with the accompanying drawings wherein:

DETAILED DESCRIPTION OF THE INVENTION

Figure 1:
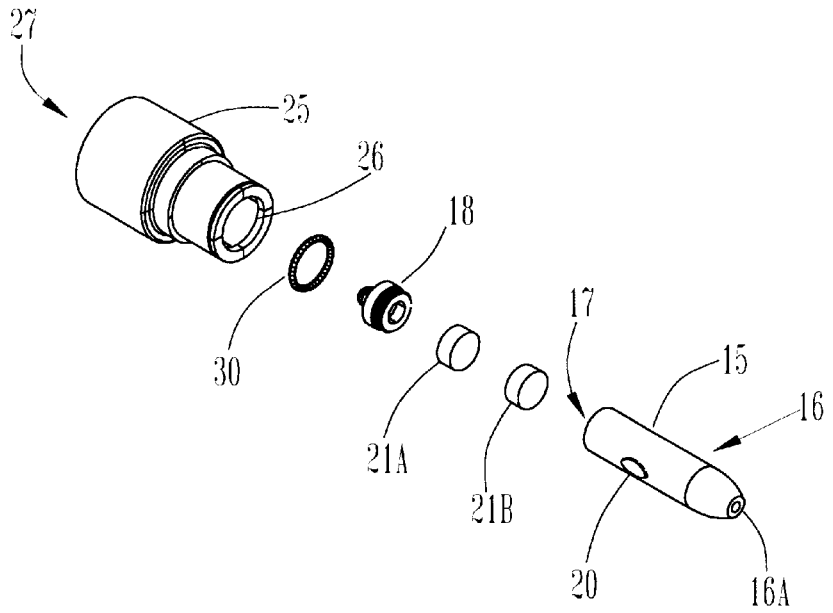
FIG. 1 is an exploded perspective view of the swing trainer device.
Figure 2:
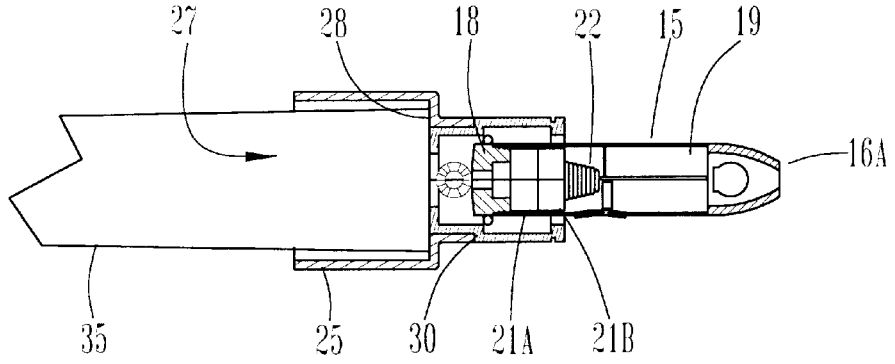
FIG. 2 is a side elevational view of the swing trainer device attached to the end of the handle of a golf club.

Referring to the drawings in FIGS. 1–5, in particular, the swing trainer device comprises a laser beam mechanism which includes a short, narrow housing 15 having a hole 16A through a front end 16 thereof and further having an open back end 17 and an end cap 18 which is threaded onto the back end 17 of the housing 15, and further includes a conventional on/off switch disposed inside the housing 15 with a depressible switch button 20 extending through an opening in the side wall of the housing 15, and also includes a compressible spring 22 which has an end connected to a laser beam light source such as a laser diode which is disposed inside the housing 15 near the front end 16 thereof so that the laser beam shines through the hole 16A in the front end 16 of the housing 15 when the laser beam light source is energized with an energy source which is essentially a pair of conventional batteries 21A–B which are disposed inside the housing 15 and urged against the spring 22 and contact switch by the end cap 18 threaded onto the back end 17 of the housing 15. A parallel light beam is directed through the hole 16A in the housing 15 upon the user depressing the switch button 20 which completes the circuit from the energy source to the laser beam light source.

Figure 3:
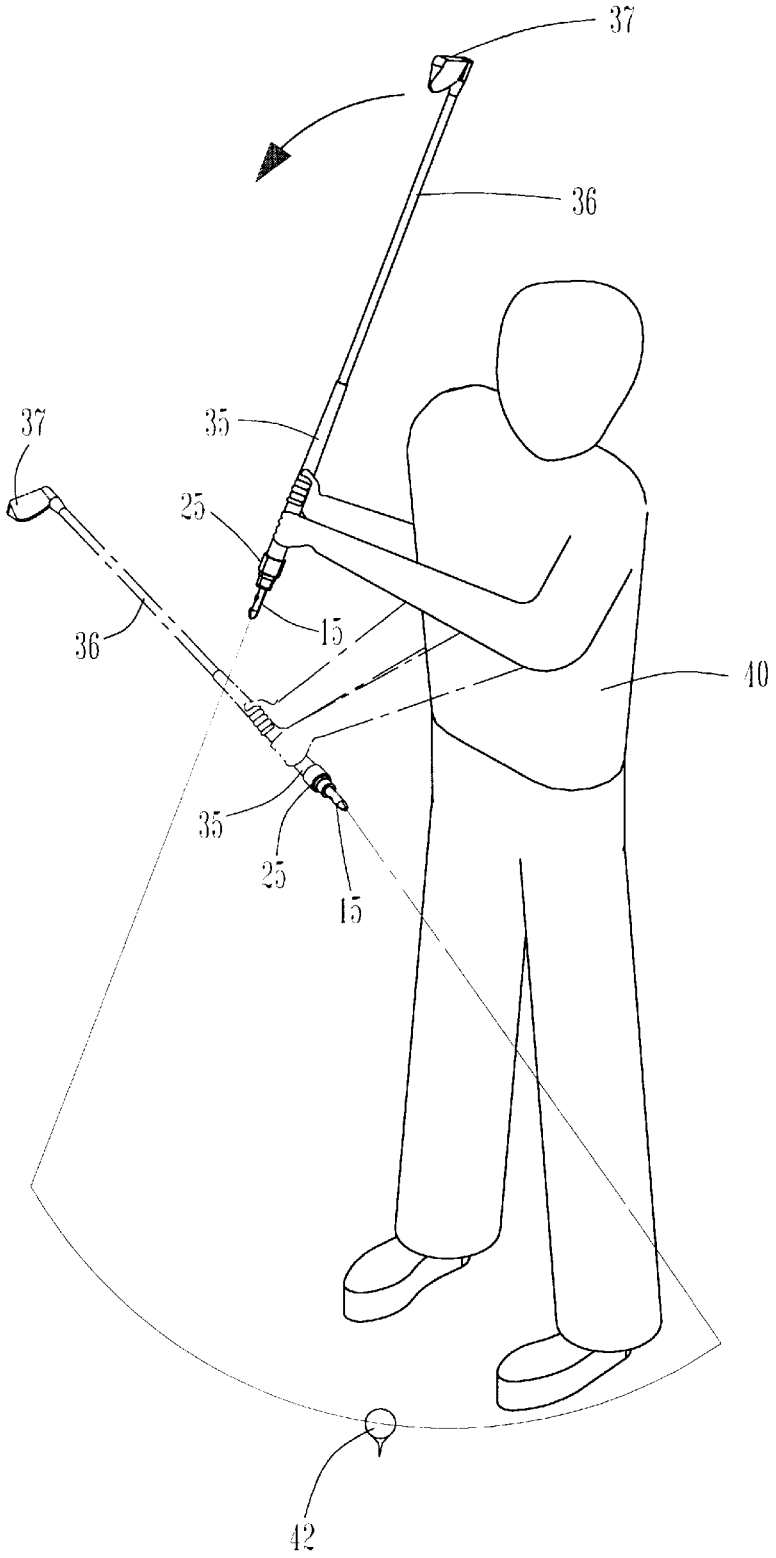
FIG. 3 illustrates the use of the swing trainer device in which the device emits a light beam which shows up on the ground as the player is making his/her swing with a golf club.
Figure 4:
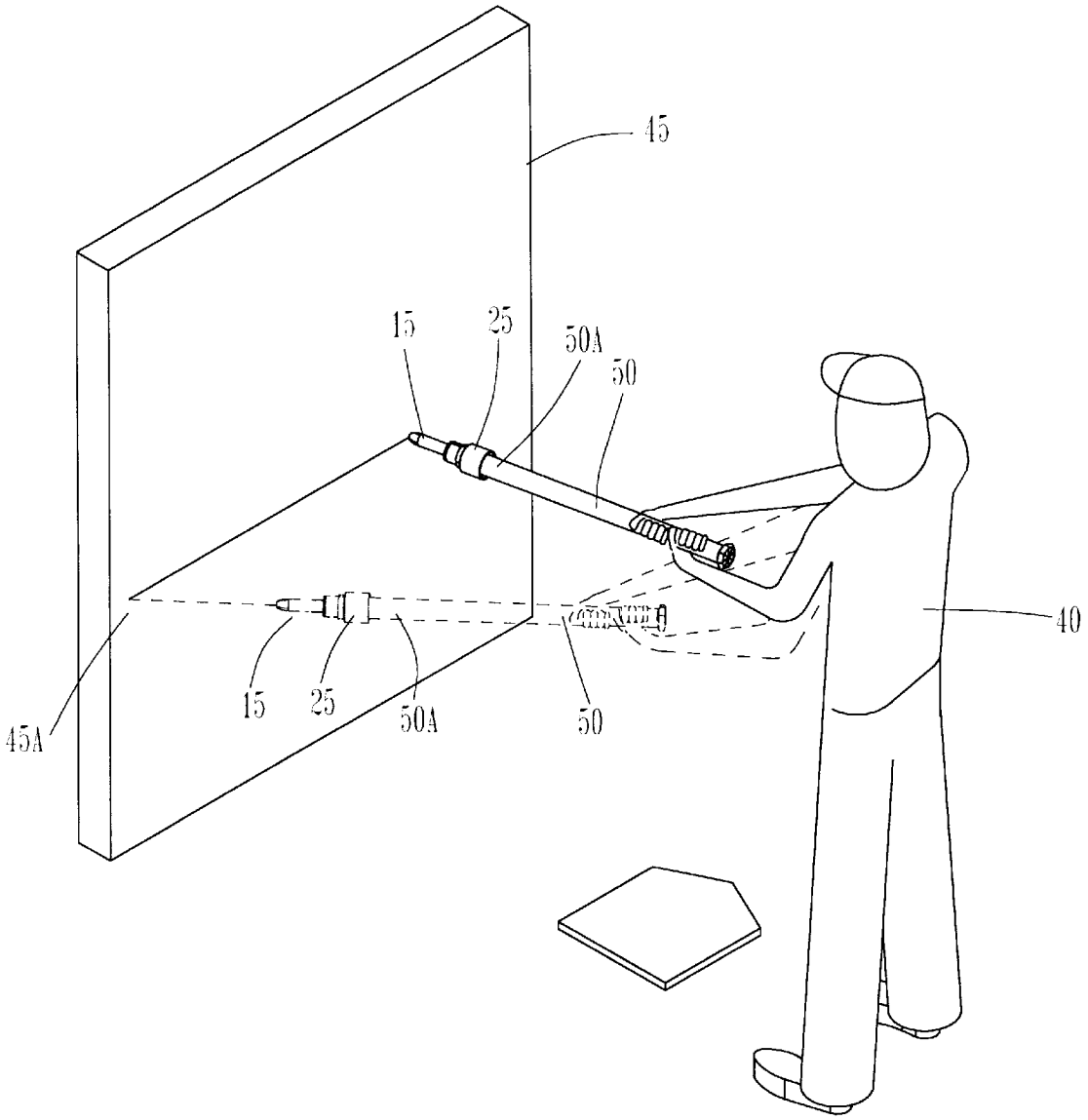
FIG. 4 illustrates the use of the swing trainer device in which the device emits a light beam which shows up on a wall structure as the player is swinging a bat.

A laser beam attachment member 25 supports the laser beam mechanism and attaches it to the end of a ball hitting implement such as a golf club 36 or a bat 50 as illustrated in FIGS. 3 & 4. The laser beam attachment member 25 has an open first end 27 and an open second end 26 with an annular stop 28 attached to the interior side of the wall and near the middle of the laser beam attachment member, and further has a retaining member 30 such as an O-ring removably disposed inside the laser beam attachment member. The opening at the first end 27 is larger relative to the opening at the second end 26 which is adapted to engageably receive the back portion of the laser beam mechanism, and the first end 27 is adapted to engageably fit about either the end of the handle 35 of any golf club 36 or the end of the barrel 50A of any bat 50 with the swing trainer device extending longitudinally from the end of the ball hitting implement. The laser beam attachment member 25 is essentially a flexible sleeve preferably made of silicone rubber which can be easily manipulated with the ends 16,17 capable of being rolled up so that the back end 17 of the laser beam mechanism can be extended into the open second end 27 of the sleeve with the retaining member 30 being removably engaged about the back portion of the laser beam mechanism, and then the second end 27 can be rolled about the back portion of the laser beam mechanism to engageably secure the laser beam mechanism to the sleeve, and so that the end of either the handle 35 of a golf club 36 or the barrel 50A of a bat 50 can be extended into the open first end 27 of the sleeve and then the first end 27 can be easily rolled about the end portion of either the handle 35 of a golf club 36 or the barrel 50A of a bat 50 to securely and removably attach the sleeve with the laser beam mechanism to the golf club 36 or bat 50. Once attached, the trainer device is coaxially aligned with longitudinal axis of either the shaft of the golf club 36 or the barrel 50A of the bat 50 such that, when put in use, the laser beam mechanism will direct an intense parallel light beam coaxially along the longitudinal axis of the shaft of the golf club 36 or the barrel 50A of the bat 50 in a direction which is away from the end of either the golf club 36 or the bat 50.

In use for golf, the player 40 selects a target 42 on a ground surface where the golf ball would be located if used, and with the sleeve engageably slipped over the end of the handle 35 of the selected golf club 36, the player 40 depresses the switch button 20 to energize the laser beam light source which emits a parallel light beam from the laser beam mechanism, and then sets himself up to properly address the target 42 where the golf ball would be located if used. The player 40 would then practice his/her swing by going through the swing motions which includes bringing the club back and upwardly essentially above and behind his/her head and would then essentially retrace that swing path by bringing the club downwardly and forwardly with the club head 37 moving through the target 42 on the ground surface. If done properly, the club head 37 should travel in a path which is in a single plane. The swing trainer device will immediately show the player 40 whether or not his/her swing is in the single plane. As the player 40 brings the club downwardly and forwardly, the light beam is directed in the same plane as the club and the club head 37 and should travel through the target 42, because in order to hit the ball, the club head 37 will also travel through the target 42. If the light beam did not travel through the target, then the player 40 needs to adjust his/her swing accordingly. For example, if the light beam travels beyond the target 42, then the player's swing may be too flat, and if the light beam travels short of the target 42, the player's swing is too upright or high. In order for the player 40 to make good accurate golf shots each and every time, the player's swing must be consistent time in and time out and should travel in a single plane. During practice, the player 40 may use a golf ball as the target 42 when using the swing trainer device.

In use for baseball, the player 40 should position oneself next to a wall structure 45 but yet far enough away so that he/she can properly swing the bat 50, and with the sleeve engageably slipped over the end of the barrel 50A of a bat 50, the player 40 depresses the switch button 20 to energize the laser beam light source which emits a parallel light beam from the laser beam mechanism, and then sets himself up in his/her batting stance facing the wall structure 45. The player 40 would then practice his/her swing by going through the swing motions which includes bringing the barrel 50A of the bat 50 through the hitting zone 45A as if he/she were going to swing at a pitched ball. As the player 40 brings the bat 50 through the horizontally-disposed hitting zone 45A, the light beam will direct a path of light upon the wall structure 45, and the player 40 can immediately see whether or not his/her swing is in a level or horizontal plane through the hitting zone 45A by watching the path traveled by the light beam. If not, the player 40 can continue to practice his/her swing until the light beam travels in a level plane through the hitting zone 45A. Through practice of either one's golf swing or one's batting swing, the player's muscles are being trained to remember one's swing path, and the player 40 with practice using the swing trainer device will be able to groom his/her swing automatically.

Various changes and departures may be made to the invention without departing from the spirit and scope thereof. Accordingly, it is not intended that the invention be limited to that specifically described in the specification or as illustrated in the drawings but only as set forth in the claims.

What is claimed is:

1. A method of using a swing trainer device comprises the steps of:

providing a swing trainer device which includes a laser beam mechanism having a laser beam light source, and further includes a laser beam attachment member with said laser beam mechanism securely attached thereto;

attaching said laser beam attachment member to an end of a ball hitting implement;

energizing said laser beam light source such that a laser beam is directed away from and generally coaxially to a longitudinal axis of said ball hitting implement; and practicing one's swing with said ball hitting implement so that one's swing is in a single plane with said laser beam consistently traveling through a selected target each and every swing.

2. A method of using a swing trainer device to practice one's swing as described in claim 1, wherein the step of providing a swing trainer device further includes providing a short, narrow housing, an on/off switch, a laser diode, and at least one battery for energizing said laser diode.

3. A method of using a swing trainer device to practice one's swing as described in claim 2, wherein the step of providing a swing trainer device further includes providing said laser beam attachment member which is essentially a flexible sleeve having an open first end adapted to engageably receive an end of said ball hitting implement, and also having an open second end adapted to engageably receive a back portion of said laser beam mechanism.

4. A method of using a swing trainer device to practice one's swing as described in claim 3, wherein the step of attaching said laser beam attachment member includes securely moving said first end of said sleeve about the end of said ball hitting implement.

5. A method of using a swing trainer device to practice one's swing as described in claim 4, wherein the step of attaching said laser beam attachment member includes rolling said first end of said sleeve onto itself and then rolling said first end of said sleeve about the end of said ball hitting implement.

6. A method of using a swing trainer device to practice one's swing as described in claim 4, wherein the step of attaching said laser beam attachment member includes securely sliding said first end of said sleeve about the end of said ball hitting implement.

7. A method of using a swing trainer device to practice one's swing as described in claim 4, wherein the step of attaching said laser beam attachment member includes moving said first end of said sleeve about the end of the handle of a golf club opposite to a club head thereof.

8. A method of using a swing trainer device to practice one's swing as described in claim 7, wherein the step of attaching said laser beam attachment member includes moving said first end of said sleeve about the end of a barrel of a bat.

9. A method of using a swing trainer device to practice one's swing as described in claim 8, wherein the step of practicing one's swing includes moving said ball hitting implement forwardly toward the target in a single plane with said laser beam effecting a path through the target for each and every swing.

10. A method of using a swing trainer device to practice one's swing as described in claim 9, wherein the step of practicing one's swing includes practicing one's swing with a golf club and with the target being on the ground surface.

11. A method of using a swing trainer device to practice one's swing as described in claim 9, wherein the step of practicing one's swing includes practicing one's swing with a bat and with the target being a horizontally-disposed hitting zone displayed on a wall structure.

12. A method of using a swing trainer device to practice one's swing as described in claim 11, wherein the step of practicing one's swing includes practicing one's batting swing by a user facing the wall structure.

* * * * *